US007530961B1

(12) United States Patent
Griffin

(10) Patent No.: US 7,530,961 B1
(45) Date of Patent: May 12, 2009

(54) SEMI-SPHERICAL HINGED HAIR WASHING HELMET

(76) Inventor: Janice A. Griffin, 6005 Lanette Rd., Baltimore, MD (US) 21206

( * ) Notice: Subject to any disclaimer, the term of this patent is extended or adjusted under 35 U.S.C. 154(b) by 805 days.

(21) Appl. No.: 11/091,296

(22) Filed: Mar. 29, 2005

(51) Int. Cl.
*A61H 1/00* (2006.01)
*A61H 23/04* (2006.01)
*A61H 35/00* (2006.01)

(52) U.S. Cl. ..... 601/49; 601/70; 601/159; 601/166; 4/515

(58) Field of Classification Search ..... 601/46, 601/69, 70, 79, 155, 159, 160, 166, 154, 601/80; 4/515–518, 520, 521
See application file for complete search history.

(56) References Cited

U.S. PATENT DOCUMENTS 998,804 A 7/1911 Salisbury
2,566,600 A * 9/1951 Colon ..... 601/97
2,854,970 A * 10/1958 Nolan ..... 601/159
2,856,918 A * 10/1958 Kingery et al. ..... 601/153
2,914,066 A 11/1959 Gow
3,044,473 A * 7/1962 Cover ..... 132/212
3,177,868 A * 4/1965 Wallace et al. ..... 601/159
3,313,037 A * 4/1967 Ullman ..... 34/99
3,348,316 A * 10/1967 Reiss et al. ..... 34/99
3,416,517 A * 12/1968 Adams et al. ..... 601/159
3,599,250 A * 8/1971 Colomb ..... 4/517
3,863,651 A * 2/1975 Vaiano ..... 132/272
4,078,557 A * 3/1978 Spencer ..... 601/114
4,469,092 A * 9/1984 Marshall et al. ..... 601/70
4,553,339 A * 11/1985 Rigo ..... 34/99
4,769,861 A 9/1988 Chang
7,028,348 B2 * 4/2006 Tadaka et al. ..... 4/516

* cited by examiner

*Primary Examiner*—Danton DeMille
(74) *Attorney, Agent, or Firm*—Crossley Patent Law; Mark A. Crossley

(57) ABSTRACT

A hinged hair washing helmet with a plurality of interior water jets emanating from an interior liquid canal, the canal also joining inlet valves with flexible inlet hoses for shampoo and conditioner. Fingers contacting a user's head provide powered massage. Power is provided by standard outlet A/C voltage or batteries. Message is adjustable for intensity. A timer control is also provided for controlling time of functions and a neck pad is adjustable for best fit of the helmet.

3 Claims, 3 Drawing Sheets

SEMI-SPHERICAL HINGED HAIR WASHING HELMET

CROSS-REFERENCE TO RELATED APPLICATIONS

Not Applicable

FEDERALLY SPONSORED RESEARVH OR DEVELOPMENT

Not Applicable

INCORPORATION BY REFERENCE OF MATERIAL SUBMITTED ON A COMPACT DISK

Not Applicable

BACKGROUND OF THE INVENTION

Field of the Invention

The invention relates to hair washing apparatus and more specifically to a semi-spherical hinged hair washing helmet.

SUMMARY OF THE INVENTION

In view of the foregoing disadvantages inherent in the known types of hair washing helmets now present in the prior art, the hinged hair washing helmet overcomes the above-mentioned disadvantages and drawbacks of the prior art.

The general purpose of the hinged hair washing helmet, described subsequently in grater detail, is to provide a hinged hair washing helmet which has many novel features that result in an improved hinged hair washing helmet which is not anticipated, rendered obvious, suggested, or even implied by prior art, either alone or in combination thereof.

To accomplish this, the hinged hair washing helmet is comprised of two halves which pivot about a hinge, thereby providing for easy access and egress of a user's head. A flex seat surrounds a user's head at an inner edge of the helmet to prevent leakage upon a user. The neck pad provides for further proper fit and adjustment of the helmet for various sizes and shapes of heads. The two helmet halves are also sealed together, when closed, with a latch mechanism to hole the halves together when latched. A water inlet valve, preferably exterior to the helmet, is adjusted for temperature mix of incoming water. Water is dispersed about the interior periphery of the helmet to be expelled toward a user's head with jets. The liquid canal within the periphery of the helmet also is joined by shampoo and conditioner via shampoo and conditioner valves, respectively, within the helmet. A liquid outlet joins the canal in the lower helmet half, providing liquid exit from the helmet. Preferably the outlet valve is exterior to the helmet. All valves may, in another embodiment, be encased within the helmet.

Vibrators are installed substantially throughout the interior periphery of the helmet and are in contact with flexible vibrating fingers, thereby providing for massage of a user's head and scalp.

An exteriorly mounted control features on/off, low, medium, and high intensity control for the vibrators. A timer is mounted on the exterior of the helmet to control the timing of all liquid valves as well as the vibrator control.

Power for the vibrator control, vibrators, and timer are provided by either batteries mounted within and accessed without the helmet, or by external standard A/C voltage.

Further, the electronics enclosure houses not only batteries but also the processor to enable the control of shampoo and conditioning flow, as well as timer functions relay and relay of vibrator control. The helmet is preferably made of plastic as well as rubberized components for sealing, such that it is lightweight and inexpensively produced. The helmet not only offers convenience and cost savings to hair salon operations, but can also be enjoyed in homes. Valuable labor time is saved by utilizing the helmet rather than have a person perform the washing and related chores.

Thus has been broadly outlined the more important features of the hinged hair washing helmet so that the detailed description thereof that follows may be better understood and in order that the present contribution to the art may be better appreciated.

Numerous objects, features and advantages of the hinged hair washing helmet will be readily apparent to those of ordinary skill in the art upon reading the following detailed description of presently preferred, but nonetheless illustrative, embodiments of the hinged hair washing helmet when taken in conjunction with the accompanying drawings.

In this respect, before explaining the current embodiments of the hinged hair washing helmet in detail, it is to be understood that the invention is not limited in its application to the details of construction and arrangements of the components set forth in the following description or illustration. The invention is capable of other embodiments and of being practiced and carried out in various ways. It is also to be understood that the phraseology and terminology employed herein are for purposes of description and should not be regarded as limiting.

Those skilled in the art will appreciate that the conception upon which this disclosure is based may readily be utilized as a basis for the design of other structures, methods and systems for carrying out the several purposes of the hinged hair washing helmet. It is therefore important that the claims be regarded as including such equivalent constructions insofar as they do not depart from the spirit and scope of the present invention.

Objects of the hinged hair washing helmet, along with various novel features that characterize the invention are particularly pointed out in the claims forming a part of this disclosure. For better understanding of the hinged hair washing helmet, its operating advantages and specific objects attained by its uses, refer to the accompanying drawings and description.

DETAILED DESCRIPTION OF THE PREFERRED EMBODIMENT

With reference now to the drawings, and in particular FIGS. 1 through 5 thereof, the preferred embodiment of the semi-spherical hinged hair washing helmet employing the principles and concepts of the present invention and generally designated by the reference number 10 will be described.

Figure 1:
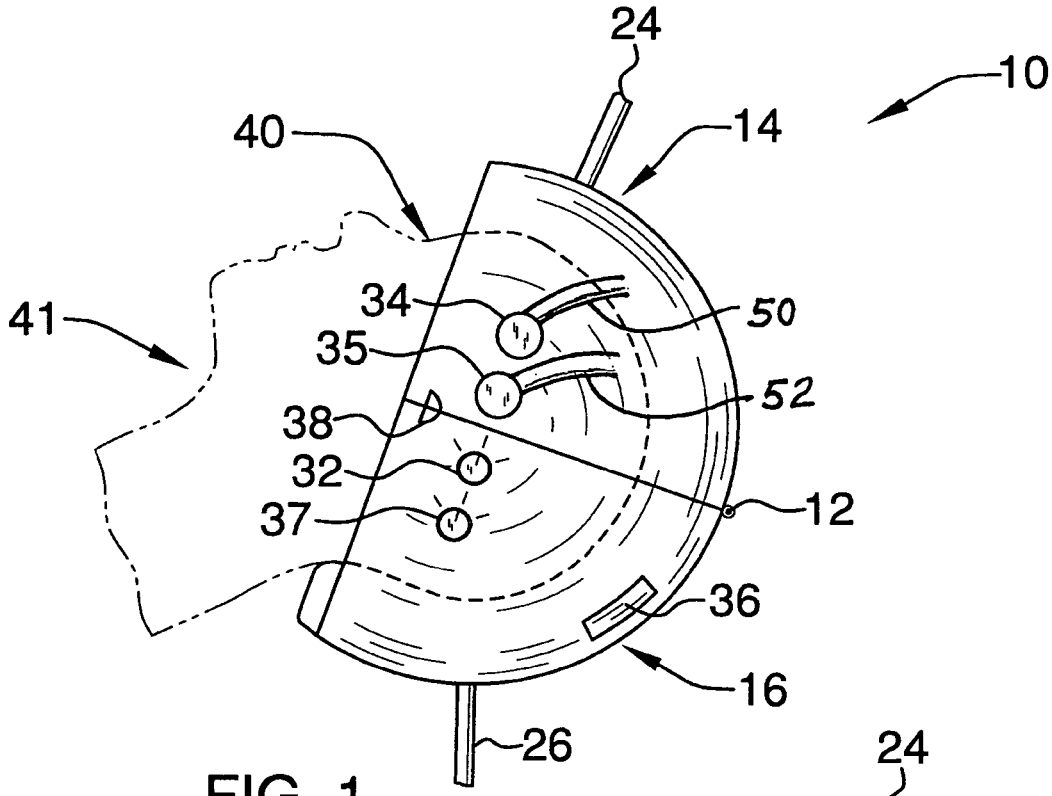
FIG. 1 is a side elevation of the hinged hair washing helmet in closed position about a user's head.

Referring to FIG. 1, the invention 10 is substantially surrounding a user's head 40. Upper helmet half 14 pivotally joins lower helmet half 16. Upper helmet half 14 and lower helmet half 16 pivot about hinge 12. Latch 38 secures upper helmet half 14 and lower helmet haft 16 together. Helmet half seal 21 seals the upper helmet half 14 to the lower helmet half 16 against leakage. Water inlet 24 enters upper helmet half 14. Shampoo inlet valve 34 is disposed within the upper helmet half 14.

Flexible shampoo inlet hose 50 enters shampoo inlet valve 34 to provide shampoo for dispersion within upper helmet half 14 and lower helmet half 16. Just below shampoo inlet valve 34 is conditioner inlet valve 35. Flexible conditioner inlet hose 52 supplies conditioner to conditioner inlet valve 35. Vibrator control 32 is in the lower helmet half 16. Vibrator control 32 is proximal to the juncture of upper helmet half 14 and lower helmet half 16. Vibrator control 32 is comprised of functions on/off, low, medium, and high which actuate and control the intensity of vibrators 30.

Figure 2:
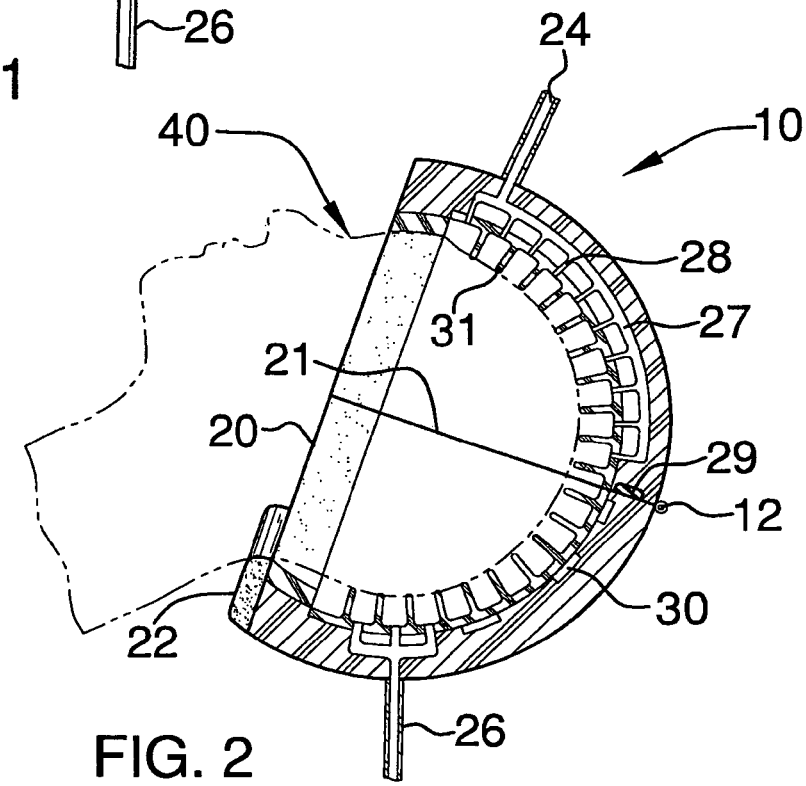
FIG. 2 is a cross sectional view of FIG. 1.

Referring to FIG. 2, pizzo-electric vibrators 30 are evenly dispersed along an interior periphery of upper helmet half 14 and lower helmet half 16. The vibrators 30 contact fingers 31. Fingers 31 contact a user's head 40. Helmet halves 14 and 16 are fitted about a user's head 40 via flex seal 20 such that the invention 10 does not leak liquids onto a user 41. Flex seal 20 thereby confines liquids to user's head 40. Neck pad 22 further fits and cushions a user's head 40. Neck pad adjustment (not shown) provides for tightening or loosening pad 22 against a user's head 40 for maximal fit and water tightness. Water inlet 24 enters upper helmet half 14 and joins liquid canal 27. Liquid canal 27 substantially surrounds a user's head 40. Liquid canal 27 joins liquid lets 28. Liquid jets 28 face a user's head 40. Liquid canal 27 is also joined (not shown) by shampoo inlet valve 34 and conditioner inlet valve 35. Any liquid introduced into liquid canal 27 is distributed about the interior periphery of helmet halves 14 and 16 and to user's head 40 via liquid jets 28. Helmet seal 21 seals upper helmet half 14 to lower helmet half 16 to prevent leakage.

O-rings 29 join upper helmet half 14 liquid canal 27 to lower helmet half 16 canal 27. Liquid canal 27 is thereby sealed to itself upon closure of the helmet halves 14 and 16.

Figure 3:
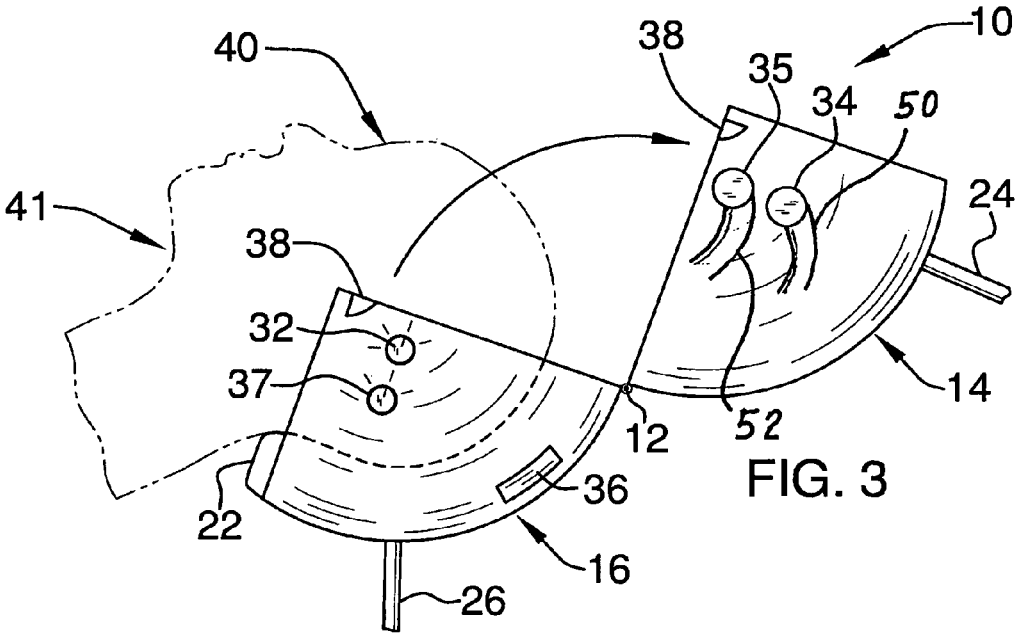
FIG. 3 is a side elevation of the hinged hair washing helmet in an open position about a user's head.

Referring to FIG. 3, helmet halves 14 and 16 are pivoted about hinge 12. Upper helmet half 14 is pivoted away from user's head 40. Electronics enclosure 36 provides access to electronic controls (not shown) for controlling vibrators 30, shampoo inlet valve 34, and conditioner inlet valve 35. Powering means is controlled by vibrator control 32, disposed in helmet half 16.

Figure 4:
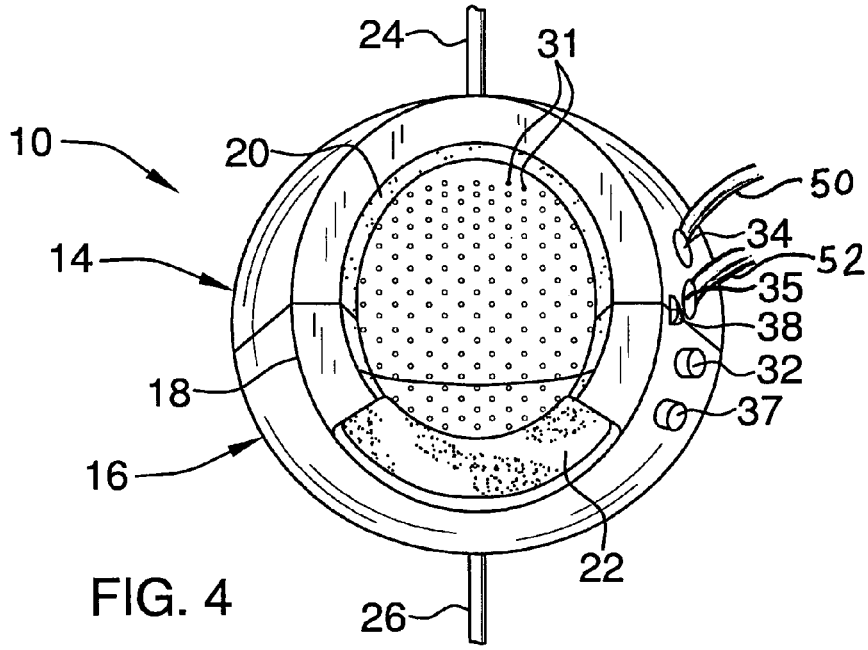
FIG. 4 is a bottom plan view of the hinged hair washing helmet.

Referring to FIG. 4, the bottom view of invention 10 reveals fingers 31 within the interior periphery of helmet halves 14 and 16. Flex seal 20, within inner edge 18 of helmet halves 14 and 16 seals liquids utilized around a user's head 40 (FIGS. 1-3).

Figure 5:
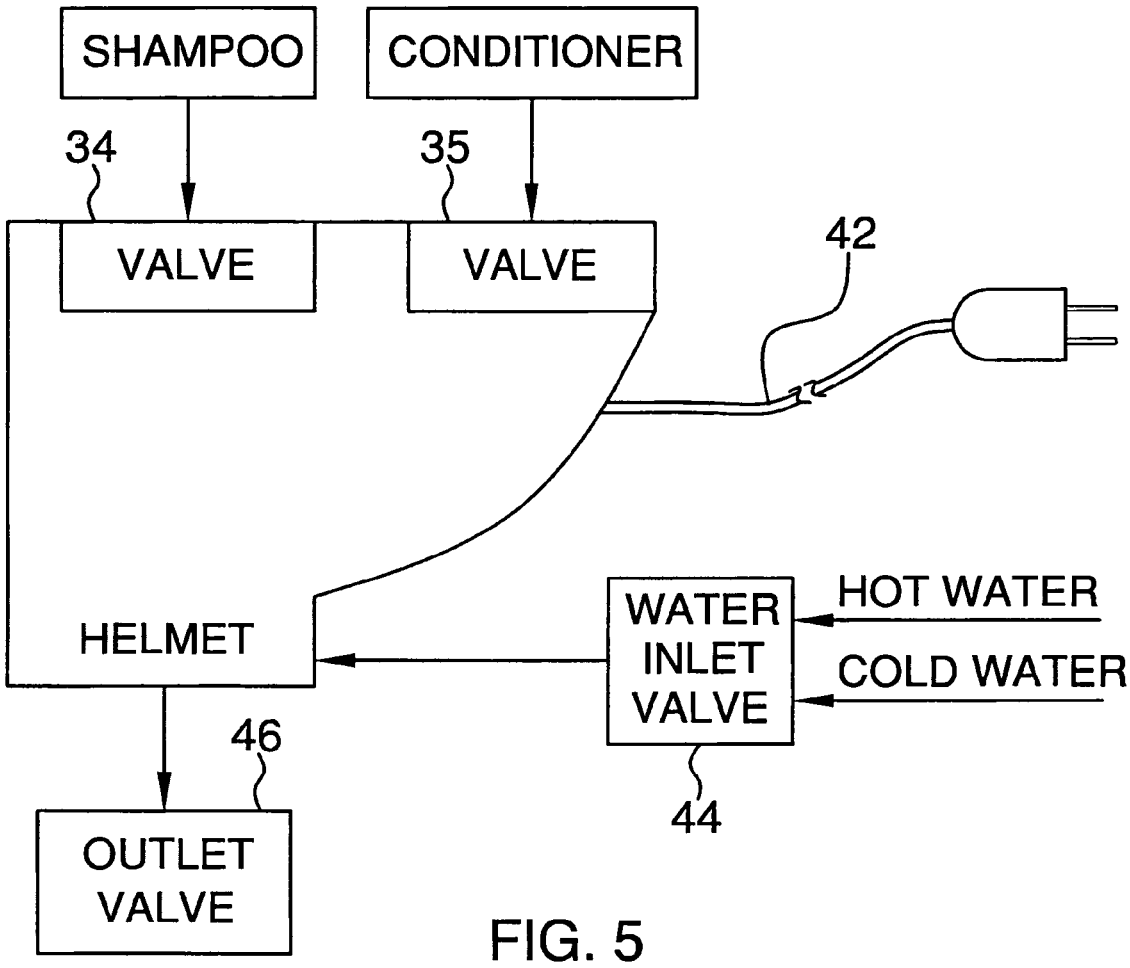
FIG. 5 is a flow chart illustrating liquid flow to and from the hinged hair washing helmet.

Referring to FIG. 5, flow of liquids into upper helmet half 14 and out of lower helmet half 16 is illustrated. Mixed hot and cold water first enters water inlet valve 44, then enters upper helmet half 14. Shampoo enters helmet half 14 via shampoo inlet valve 34, and conditioner enters helmet half 14 via conditioner inlet valve 35. Liquid outlet 26 (FIGS. 1-4) flows into exterior outlet valve 46. Outlet valve 46 is exterior to lower helmet half 16.

In use, user 41 is typically seated in a chair (not shown) with head 40 tilted back upon a support (not shown). User's head 40 is lifted to allow lower helmet half 16 to be placed between the support and user's head 40. Upper helmet half 14 is pivoted about hinge 12 to close about head 40. Latch 38 is engaged to secure helmet half 14 to helmet half 16.

Neck pad adjustment is utilized for optimal fit of the invention 10 to user's head 40. A/C power cord 42 is plugged into typical A/C power source (not shown). Alternately, powering means is provided by batteries (not shown) within electronics enclosure 36.

Hot water and cold water mix is set for entry into water inlet valve 44. Timer 37 is set to control liquid entry and vibrators 30, sequentially. Vibrator control 32 is set for vibrator 30 intensity. Invention 10 cycles through a use cycle, first wetting hair via water inlet 24, then adding shampoo via operation of shampoo inlet valve 34, then rinsing via inlet 24, then adding conditioner via operation of conditioner inlet valve 35, then rinsing via inlet 24. Exterior outlet valve 46 cycles between each operation and after rinse. Vibrator control 32 is further controlled by timer 37 for initiation and duration of vibration of vibrators 30. Upon cessation of invention 10 use cycles, upper helmet half 14 is provided to open (FIG. 3) thereby allowing egress of head 40.

With respect to the above description then, it is to be realized that the optimum dimensional relationships for the parts of the hinged hair washing helmet, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A semi-spherical hinged hair washing helmet for use with typical cold and hot water supplies, the helmet comprising:

a water inlet valve, the inlet valve controlling the supply of hot and cold water;

a flexible water inlet disposed within an upper helmet half, the water inlet connected to the water inlet valve;

a hinged helmet of two halves, the upper helmet haft and a lower helmet half;

a helmet half seal joining the two halves of the helmet, whereby the helmet is sealed against leakage when closed;

a watertight flex seal about an inner edge of an opening of the helmet;

a liquid canal within the helmet, the liquid canal communicating with the water inlet the liquid canal substantially throughout an interior periphery of both halves of the helmet;

o-rings at a juncture of the two helmet halves, the o-rings disposed at points of contact of the liquid canals of the two helmet halves;

a plurality of liquid jets facing the user's head, the liquid jets communicating with the liquid canal;

a shampoo inlet hose in the upper helmet half, the shampoo inlet hose communicating with the liquid canal;

a shampoo inlet valve controlling the shampoo inlet hose, the shampoo inlet valve disposed at an inlet to the helmet of the shampoo inlet hose;

a conditioner inlet hose within the upper helmet half, the conditioner inlet hose communicating with the liquid canal;

a conditioner inlet valve controlling the conditioner inlet hose, the conditioner inlet valve disposed adjacent to the conditioner inlet hose;

a flexible liquid outlet departing the lower helmet half, the liquid outlet communicating with the user's head;

a plurality of pizzo-electric vibrators, the vibrators evenly distributed throughout the interior periphery of the helmet;

a plurality of flexible fingers extending from the vibrators, the fingers for contacting the user's head;

powering means for the pizzo-electric vibrators;

a timer disposed within the helmet, the timer controlling the powering means for the vibrators, the shampoo inlet valve, the conditioner inlet valve, and the water inlet valve;

electronic controls within an electronics enclosure disposed within the outer periphery of the helmet, the electronic controls communicating with the timer and the vibrators;

an exterior outlet valve disposed separately from the helmet, the exterior outlet valve controlling the liquid outlet.

2. The invention of claim 1 wherein a latch selectively secures the upper helmet half to the lower helmet half when the helmet is closed.

3. A method of using the semi-spherical hinged hair washing helmet of claim 1 to wet, shampoo, condition, massage, and rinse a user's hair and scalp, the method comprising the steps of:

positioning the user's hair and scalp in proximity to the helmet;

lifting a user's head;

fitting a lower half of the helmet under the user's head;

closing an upper half of the helmet about the user's head;

latching a latch of the helmet to secure the upper half to the lower half;

setting a timer for wash, shampoo, condition, massage, and rinse cycles;

allowing time for the helmet to perform the cycles;

unlatching the latch;

lifting the upper helmet half;

removing the user's head from the lower helmet half.

* * * * *